US011511985B2

(12) United States Patent
Juratovac

(10) Patent No.: US 11,511,985 B2
(45) Date of Patent: Nov. 29, 2022

(54) CONTACTLESS BEVERAGE DISPENSER

(71) Applicant: Vincent Theodore Juratovac, Star Tannery, VA (US)

(72) Inventor: Vincent Theodore Juratovac, Star Tannery, VA (US)

( * ) Notice: Subject to any disclaimer, the term of this patent is extended or adjusted under 35 U.S.C. 154(b) by 0 days.

(21) Appl. No.: 17/445,030

(22) Filed: Aug. 13, 2021

(65) Prior Publication Data

US 2022/0098022 A1 Mar. 31, 2022

Related U.S. Application Data

(60) Provisional application No. 63/198,095, filed on Sep. 29, 2020.

(51) Int. Cl.
*B67D 1/08* (2006.01)
*B67D 1/00* (2006.01)

(52) U.S. Cl.
CPC ..... *B67D 1/0888* (2013.01); *B67D 1/0005* (2013.01); *B67D 1/0801* (2013.01); *B67D 2001/0097* (2013.01); *B67D 2210/00089* (2013.01)

(58) Field of Classification Search
CPC .. B67D 1/0888; B67D 1/0005; B67D 1/0801; B67D 2001/0097; B67D 2210/00089
See application file for complete search history.

(56) References Cited

U.S. PATENT DOCUMENTS 5,588,558 A * 12/1996 Cox ..... G01F 23/2921 222/64
6,227,265 B1 5/2001 Skell et al.
6,705,356 B2 3/2004 Barton et al.
8,028,728 B2 10/2011 Cooper
8,572,772 B2 11/2013 Wolf et al.
8,813,794 B2 8/2014 Ashrafzadeh et al.
9,004,115 B2 4/2015 Krause et al.
9,164,518 B2 10/2015 Houghton
9,526,805 B2 12/2016 Pawlow
9,926,181 B1 3/2018 Volftsun et al.
10,233,069 B2 3/2019 Chase et al.
10,294,093 B1 5/2019 Volftsun et al.
10,337,662 B1 7/2019 Gradillas et al.
2003/0159460 A1 8/2003 Netter
2006/0112990 A1 6/2006 Shiloni
2014/0188271 A1* 7/2014 Hernandez ..... G06F 3/0488 700/232
2016/0122173 A1* 5/2016 Ka ..... B01D 35/00 222/1

(Continued)

FOREIGN PATENT DOCUMENTS

WO WO-2020264376 A1 * 12/2020

*Primary Examiner* — Donnell A Long

(74) *Attorney, Agent, or Firm* — Dunlap Bennett & Ludwig, PLLC

(57) ABSTRACT

A contactless beverage dispenser, system, and method of contactlessly dispensing a beverage are disclosed herein. Embodiments of the present invention utilize a sensor that is operatively coupled to a pump for selective activation thereof. The sensor detects, in a sensor zone, the presence of a beverage container proximal a dispensing spout of the beverage dispenser. The sensor may be a proximity sensor, such as a photoelectric sensor. Upon detection of the beverage container, the pump is activated and dispenses a beverage to a user.

13 Claims, 6 Drawing Sheets

(56) References Cited

U.S. PATENT DOCUMENTS

| | | | | |
|---|---|---|---|---|
| 2018/0093875 | A1* | 4/2018 | Steele | B67D 1/1243 |
| 2020/0063409 | A1 | 2/2020 | Wall et al. | |
| 2020/0122994 | A1* | 4/2020 | Cimatti | G06Q 20/145 |
| 2022/0017347 | A1* | 1/2022 | Conway | B67D 1/0021 |

* cited by examiner

CONTACTLESS BEVERAGE DISPENSER

CROSS-REFERENCE TO RELATED APPLICATION

This application claims the benefit of priority of U.S. provisional application No. 63/198,095, filed Sep. 29, 2020, the contents of which are herein incorporated by reference.

BACKGROUND OF THE INVENTION

The present invention relates to liquid dispensing and, more particularly, to a touchless/contactless liquid dispenser.

Beverage dispensers are used for serving drinks on a large scale and in a manner that each individual can serve themselves from it. Epidemics, such as the coronavirus disease 2019 (COVID-19) epidemic, prevent vendors from being able to safely distribute beverages, such as cold bulk water, flavored drink beverages (such as GATORADE™), and other consumable liquids, because commonly touched surfaces become a hazard (during pandemics and due to other diseases that may be present at any given time). Consequently, prior to the present invention, there was no way to safely hydrate worker at job sites, factories, sporting events and other group settings where individuals are usually in need of hydration.

Conventional solutions require touching or depressing of a button to activate the liquid dispenser. A popular example of such is a five-gallon drink dispenser with a spout and pour button disposed at a lower end thereof. Furthermore, the solutions require putting the cup close to or touching the spout to catch the beverage being dispensed. If an individual has already drank out of the cup (which is very frequently the case), there is even more possibility to spread various types of germs (including, but not limited to, COVID-19).

As can be seen, there is a need for a contactless, mobile liquid dispenser in accordance with the present invention.

SUMMARY OF THE INVENTION

In one aspect of the present invention, a beverage dispenser comprises: a reservoir configured to contain a beverage; a dispensing spout configured to dispense the beverage; a sensor configured to detect when a beverage container is disposed in a sensor zone proximal the dispensing spout; and a pump operably coupled to the reservoir and the dispensing spout, the pump being configured to pump the beverage out of the dispensing spout upon the detection, by the sensor, of the beverage container being disposed in the sensor zone.

In another aspect of the present invention, a beverage dispenser system comprises: a reservoir; a beverage contained within the reservoir; a dispensing spout configured to dispense the beverage; a beverage container; a sensor configured to detect when the beverage container is disposed in a sensor zone proximal the dispensing spout; and a pump operably coupled to the reservoir and the dispensing spout, the pump being configured to pump the beverage out of the dispensing spout upon the detection, by the sensor, of the beverage container being disposed in the sensor zone.

In another aspect of the present invention, a method of dispensing a beverage comprises the steps of: providing a reservoir; providing a beverage contained within the reservoir; providing a dispensing spout that is configured to dispense the beverage; providing a beverage container; providing a sensor configured to detect when the beverage container is disposed in a sensor zone proximal the dispensing spout; providing a pump operably coupled to the reservoir and the dispensing spout; positioning the beverage container in the sensor zone; detecting, by the sensor, the beverage container being disposed in the sensor zone; and pumping, by the pump, the beverage out of the dispensing spout.

These and other features, aspects and advantages of the present invention will become better understood with reference to the following drawings, description and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
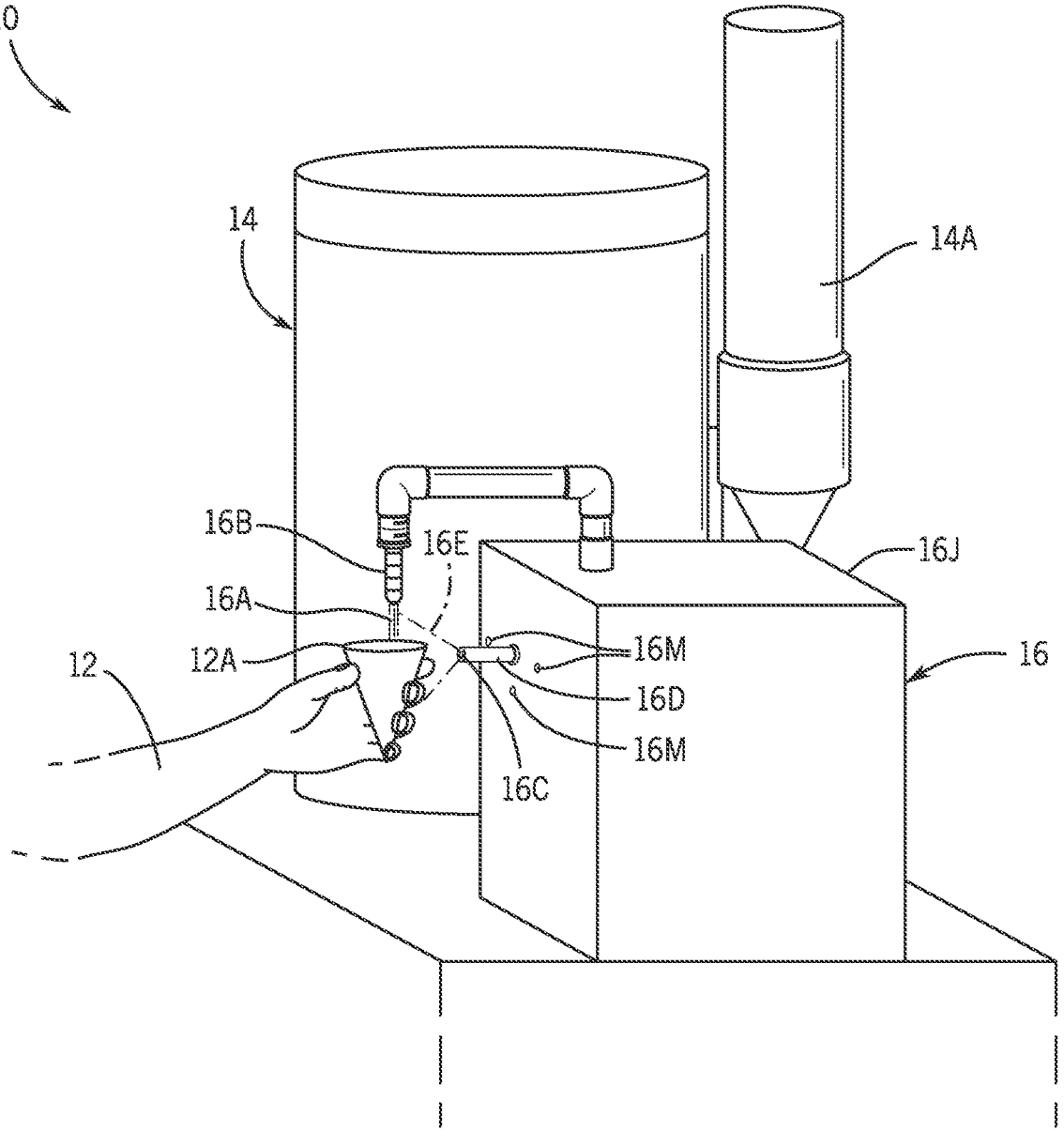
FIG. 1 is a front perspective view of an embodiment of the present invention, shown in use with a user.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, an embodiment of the present invention provides a contactless beverage dispenser. This embodiment makes use of a sensor that is operatively coupled to a pump for selective activation thereof. The sensor is positioned to detect, in a sensor zone thereof, the presence of a beverage container being located proximal a dispensing spout of the beverage dispenser. Upon detection of the beverage container, the pump is activated to pump and dispense a beverage out the dispenser spout and into the beverage container for a user to consume.

In accordance with certain aspects of the present invention, after filling a cooler (which may be insulated) with a beverage, and individual may put his/her bottle or other liquid container (e.g., a cup) a predetermined distance away from a fill spout, and the liquid is dispensed from the fill spout, stopping when the liquid container is pulled away. In certain embodiments, the predetermined distance may be approximately 2.5 inches. Other than the liquid/beverage container, which must be grasped by the individual, no contact or touching is required to dispense the beverage, eliminating germ transmission due to physical contact with parts of the beverage dispenser. At any event where beverages are supplied (such as sporting events, job sites, etc.), germ transmission is reduced or eliminated due to embodiments of the present invention.

In future iterations of embodiments of the present invention, it could be provided as a more compact, less expensive unit, provided that the functionality remains the same. Various means of power may be provided in accordance with the present invention. For example, embodiments of the present invention may be powered by 120 volts alternating current and/or 12 volts direct current. As will be readily apparent to one of ordinary skill in the art, the contactless beverage dispensing technology discussed herein may be applied to various types of beverages, such as water, GATORADE™, soda, and more.

Referring now to FIGS. 1-4, a touchless beverage dispenser 10 is shown. The dispenser 10 includes a beverage reservoir 14 (which may be embodied as, for example, a cooler of various sizes), a beverage container dispenser 14A, and a housing assembly 16 (which houses electrical connections, and in certain embodiments may be embodied as a junction box). The beverage container dispenser 14A retains beverage containers 12A, which are selectively removed by a user 12 for use contactlessly, as described in greater detail below. As those with skill in the art will appreciate, any appropriate container (e.g., bottle, cup, mug, glass, etc.) may be used in accordance with the present invention. The beverage reservoir 14, in use, holds a beverage 16A to be dispensed. Alternatively, those with skill in the art will appreciate that users 12 may also supply their own containers.

The housing assembly 16, in use, dispenses a beverage 16A via a dispensing spout 16B. The housing assembly 16 may be provided with a photo eye 16C (i.e., a photoelectric sensor), mounted on an outer surface thereof, and a support 16D for supporting the photo eye 16C. As shown in FIG. 1, the support 16D extends the photo eye 16C proximal a region in which the beverage 16A is dispensed. A sensor zone 16E is shown in dashed lines in FIGS. 1-3 and is representative of the region in which the photo eye 16C is capable of sensing the presence of a beverage container 12A (in particular, see FIG. 1). As will be appreciated by those with skill in the art, other proximity-based sensors may be used in accordance with the present invention.

A plurality of sanitizing lights 16M (such as ultraviolet light emitting diodes (LEDs)) may be provided adjacent the support 16D to provide sanitization of the area around where the beverage 16A is discharged (including the dispensing spout 16B), even further reducing the risk of germ transmission when utilizing the dispenser 10. The sanitizing ultraviolet lights 16M may run continuously to constantly disinfect the spout 16B so that it is disinfected in the event a user 12 or container 12A accidentally comes into contact with the spout 16B. Alternatively, in other embodiments, the lights 16M may be selectively activated when the photo eye 16C detects the presence of the beverage container 12A in the sensor zone 16E.

Figure 2:
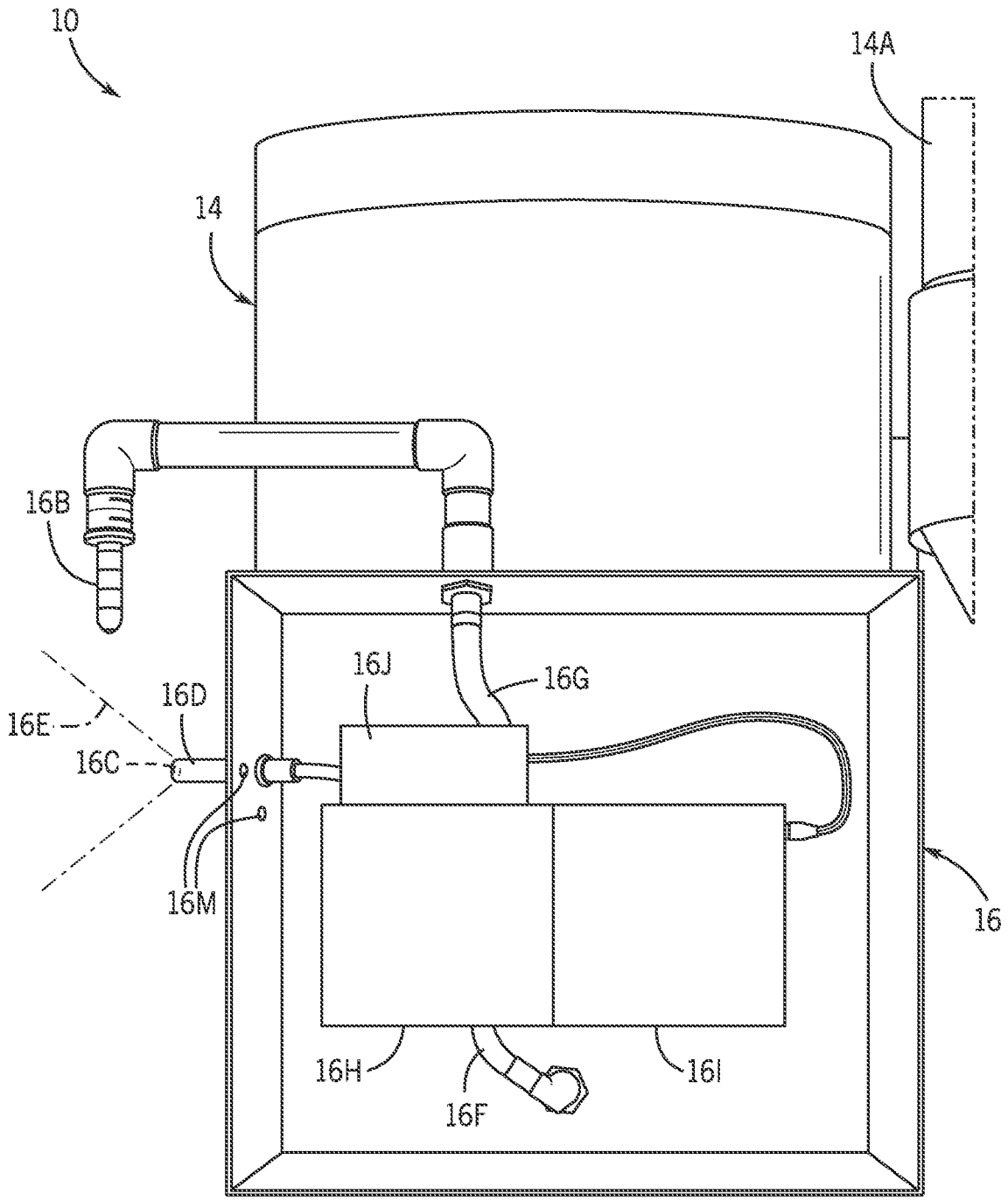
FIG. 2 is a side perspective view of the embodiment of the present invention, with a portion of a junction box of the present invention cut away to expose internal components of the illustrated embodiment.
Figure 3:
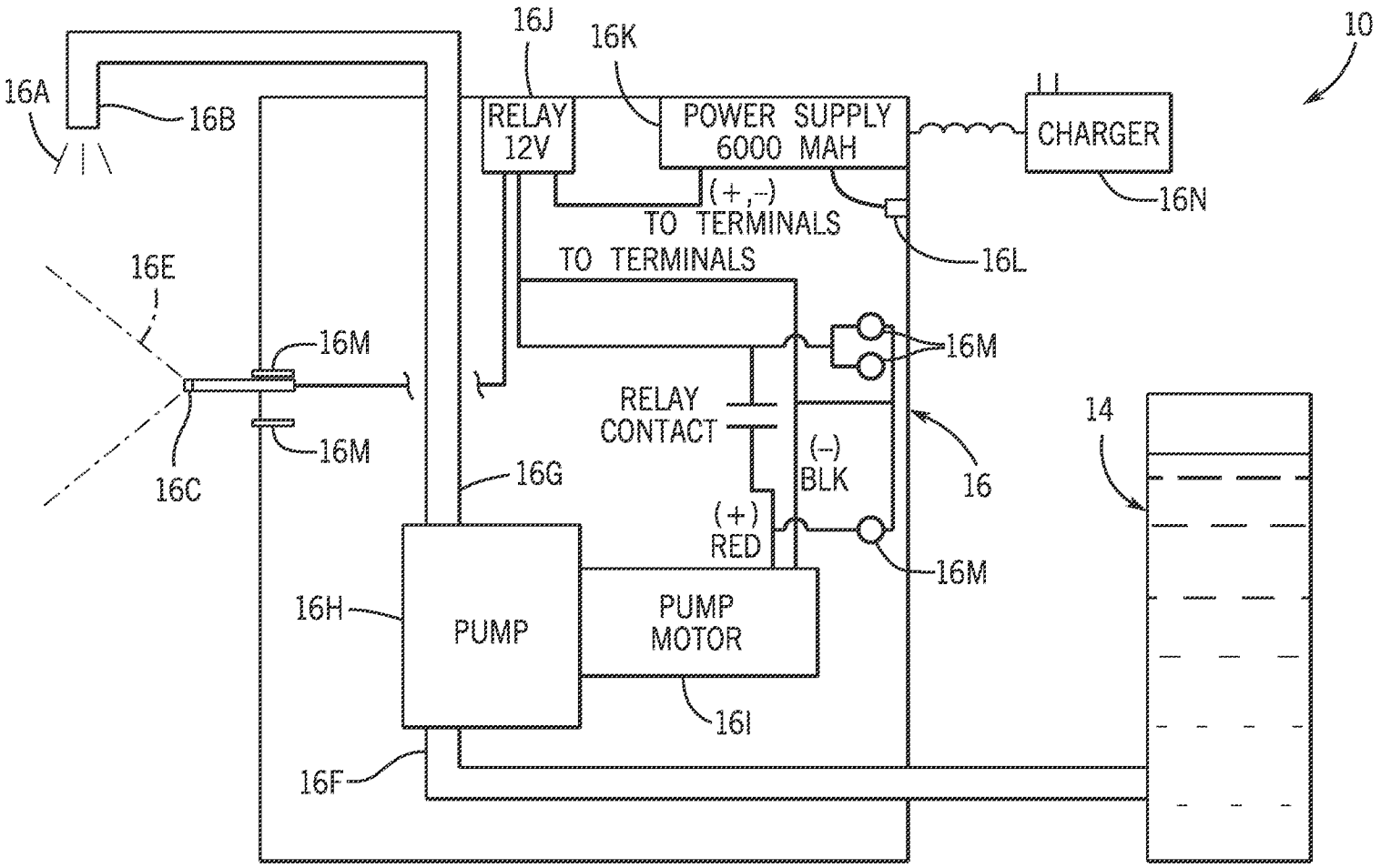
FIG. 3 is a schematic side elevation view of the embodiment of the present invention.
Figure 4:
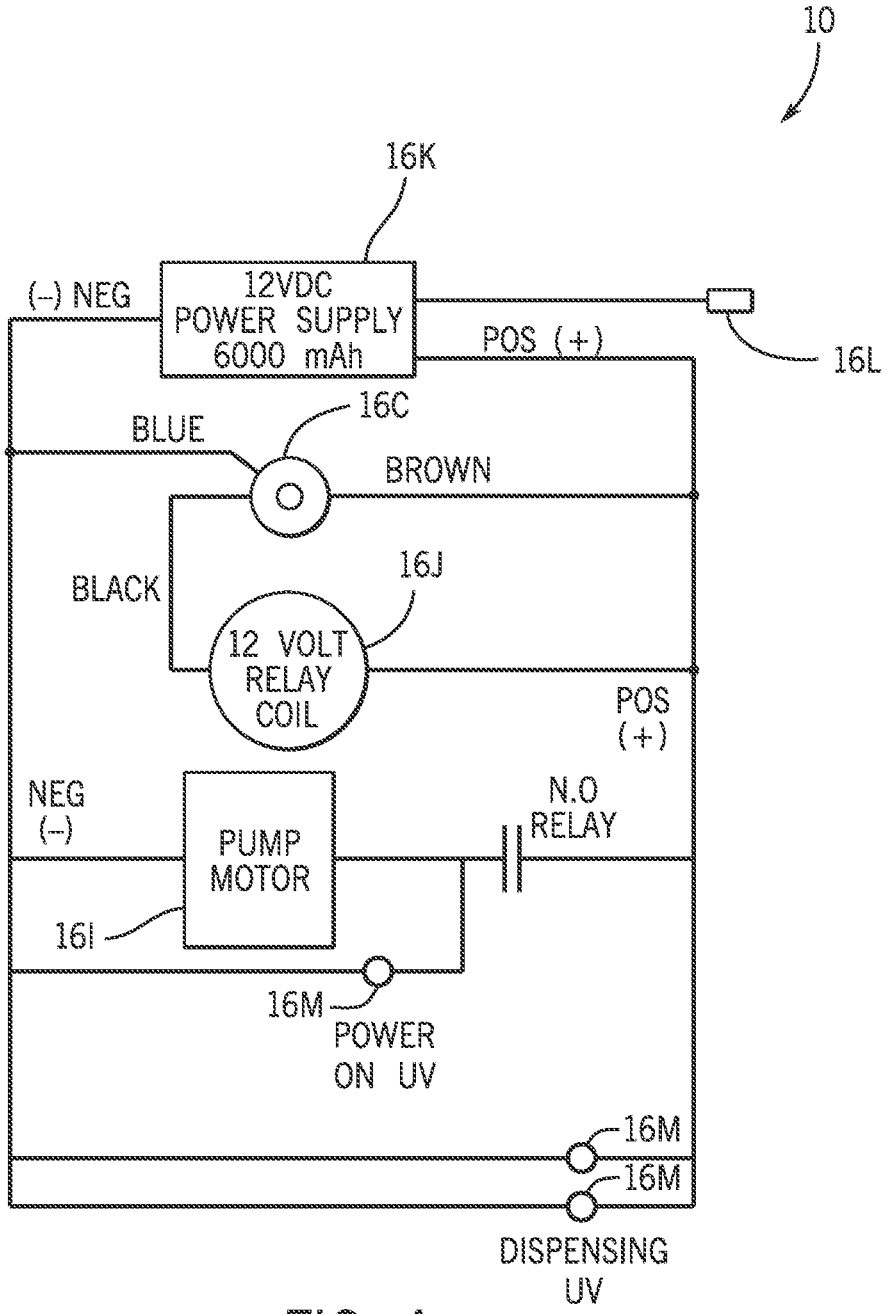
FIG. 4 is an electrical schematic view of the embodiment of the present invention.

Referring now to FIGS. 2 and 3, the housing assembly 16 may further include a beverage inlet 16F (which, as shown in FIG. 2, is a conduit) for receiving the beverage 16A from the beverage reservoir 14. A beverage outlet 16G (which, as shown in FIG. 2, is a conduit) is provided for the beverage 16A to exit to the dispensing spout 16B, with a potable liquid pump 16H for pumping the beverage 16A from the reservoir 14 to the dispensing spout 16B. The pump 16H is controlled by a pump motor 161. A relay 16J is provided that selectively energizes and de-energizes the pump motor 161 of the dispenser 10 upon a sensing signal being delivered by the photo eye 16C.

Further, as shown in FIG. 3, a power supply 16K (such as a battery) is provided so that the dispenser 10 may be operated without need of a power outlet nearby. In certain embodiments, the power supply 16K may have a capacity of 6000 mAh that is capable of dispensing more than 50 gallons of beverage 16A prior to needing to be recharged. A power connector 16N (e.g., a charger) is provided for charging the power supply 16*k* of the dispenser 10. When charging, and as shown in FIG. 3, the power connector 16N connects to an external female charging jack 16L. In other embodiments, a solar charger may be used such that wall power is not needed to recharge the dispenser 10. Due to this power cordless design, it may be used as a mobile unit, or may be provided in a fixed location. It is noted that ultraviolet lights 16N are illustrated in two locations in FIG.3 to show them schematically (right side of FIG. 3) in a circuit of the present invention and also exemplary physical placement of them (left side of FIG. 3).

In use, the dispenser 10 is first placed at a location, such as a job site, event, or other location where a user 12 would typically need or want a beverage 16*a* dispensed. The user 12 then places a beverage container 12A underneath a dispensing spout 16B of the dispenser 10. The location/region directly underneath the dispensing spout 16B where the user 12 places the container 12A is located a predetermined distance away from a photo eye 16C (such as 2.5 inches). As shown in FIG. 1, the beverage container 12A does not physically contact any portion of the dispenser 10. As shown in FIGS. 1-3, the photo eye 16C is located below the dispensing spout 16B such that it is directed at the location the container 12A is positioned. Within this general region (e.g., which at least partially overlaps within the sensor zone 16E), the photo eye 16C detects the presence of the beverage container 12A, causing the relay 16J to switch and activate the pump motor 161 and pump 16H, thus dispensing the beverage 16A (i.e., a portion of the beverage 16A, since the reservoir 14 is typically embodied to hold large quantities of the beverage 16A). The ultraviolet sanitizing lights 16M may always be on, or they may be selectively activated when the photo eye 16C detects the beverage container 12A. When no additional beverage 16A is desired in the container 12A, it may be pulled away from the dispensing spout 16B, and the photo eye 16C causes the relay 16J to switch again and deactivate the pump 16H (and, in certain embodiments, deactivate the ultraviolet lights 16M). Thus, beverages 16A may be dispensed in a contactless manner to users 12, decreasing the transmission of germs that would otherwise result from touching physical buttons or pressing the container 12A up against a conventional dispenser.

Figure 5:
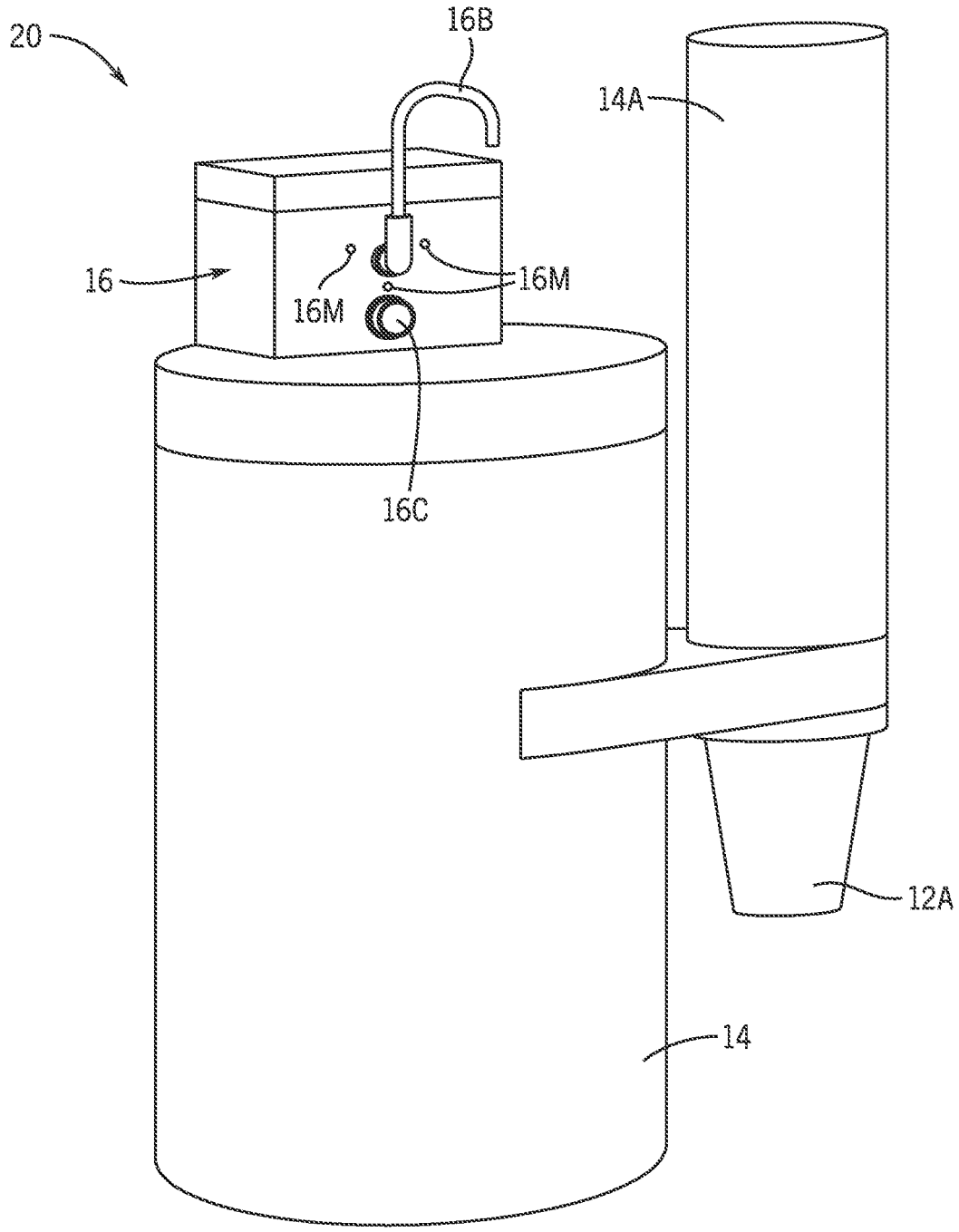
FIG. 5 is a perspective view of a modified embodiment of the present invention.
Figure 6:
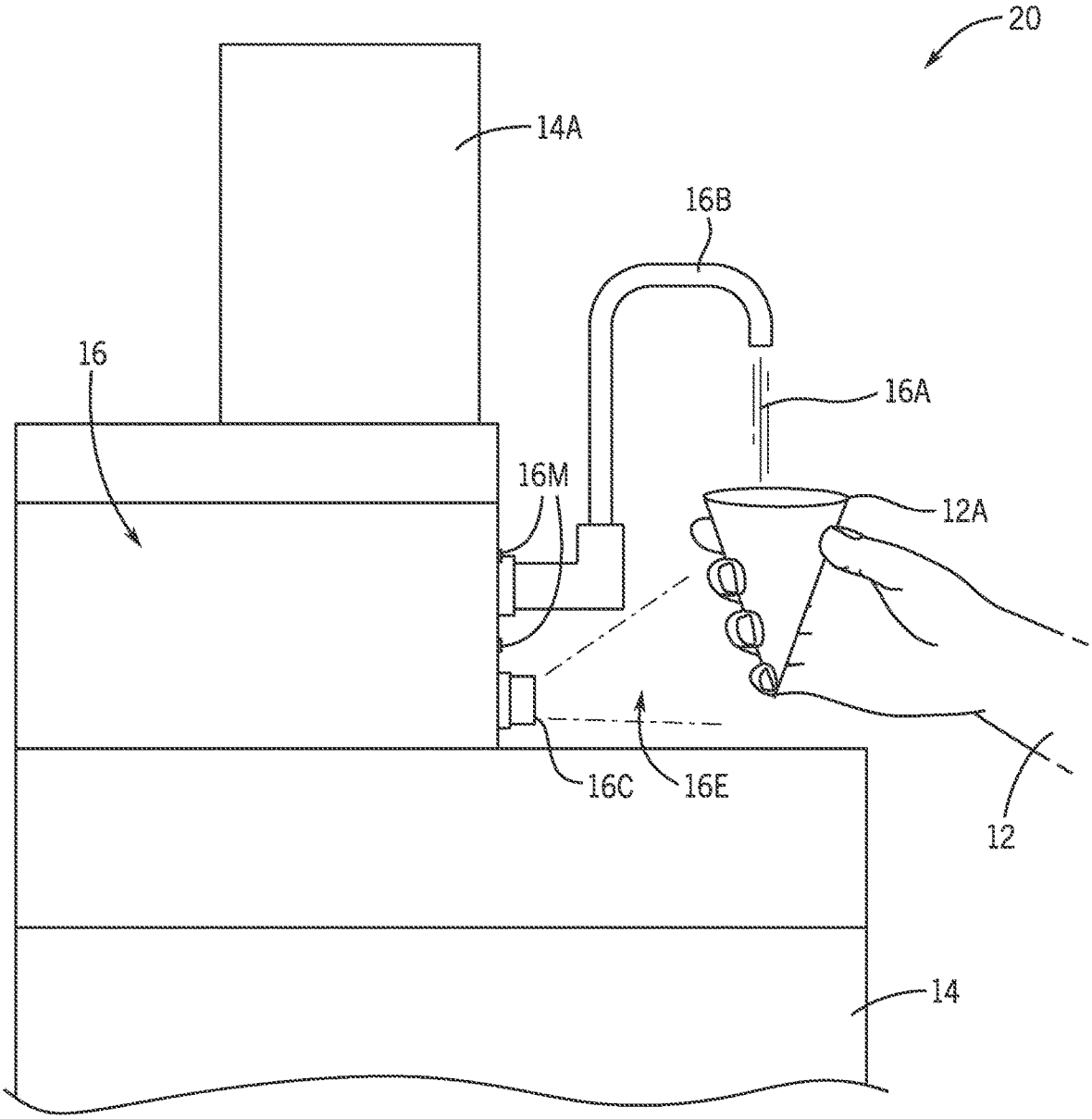
FIG. 6 is a detailed side elevation view of the modified embodiment, shown in use with the user.

FIGS. 5 and 6 show a modified version 20 of the embodiment of the present invention that aesthetically appears different from the embodiment described above in detail but is functionally the same and all discussion herein applies to both embodiments. Specifically, FIGS. 5 and 6 illustrate an embodiment which envisions mounting the housing assembly 16 on top of the beverage reservoir 14, rather than sitting adjacent it. Further, as shown, the dispensing spout 16B and photo eye 16C may take various shapes/forms, provided that the same functionality is achieved in terms of contactless dispensing of beverages 16*a*.

As evidenced by the embodiments of FIGS. 1-3 and FIGS. 4-5, the present invention may be embodied in various forms, and any appropriate method of making such embodiments would be readily apparent to one of ordinary skill in the art from the foregoing disclosure and FIGS. 1-5, which detail the mechanical and electrical design employed. It will be appreciated that all components that interact with the beverage 16A should be formed from food-grade materials. It will be appreciated, of course, that other physical and electrical implementations are within the spirit and scope of the present disclosure, provided that the contactless features described are still functionally provided in such alternative implementations.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A beverage dispenser comprising:

a reservoir configured to contain a beverage;

a dispensing spout configured to dispense the beverage;

a sensor configured to detect when a beverage container is disposed in a sensor zone proximal the dispensing spout;

a pump operably coupled to the reservoir and the dispensing spout, the pump being configured to pump the beverage out of the dispensing spout upon the detection, by the sensor, of the beverage container being disposed in the sensor zone; and one or more ultraviolet lights configured to sanitize at least one of the dispensing spout and a portion of the sensor zone wherein the one or more ultraviolet lights are operative when the beverage container is disposed in the sensor zone.

2. The beverage dispenser of claim 1, wherein the sensor is a proximity sensor.

3. The beverage dispenser of claim 2, wherein the proximity sensor is a photoelectric sensor.

4. The beverage dispenser of claim 1, wherein the sensor is mounted to a housing such that the sensor is disposed a predetermined horizontal distance from the dispensing spout.

5. The beverage dispenser of claim 4, wherein the sensor is located below the dispensing spout.

6. The beverage dispenser of claim 1, wherein the one or more ultraviolet lights are configured to run continuously.

7. The beverage dispenser of claim 1, further comprising a housing in which the pump is mounted, an inlet conduit coupled to the reservoir and the pump, and an outlet conduit coupled to the pump and the dispensing spout.

8. The beverage dispenser of claim 1, further comprising a relay electrically coupled to the sensor and the pump to selectively activate and de-activate the pump based upon the detection, by the sensor, of the beverage container.

9. The beverage dispenser of claim 1, wherein the one or more ultraviolet lights selectively activate when the beverage container is disposed in the sensor zone.

10. The beverage dispenser of claim 1, wherein the one or more ultraviolet lights are positioned adjacent to a support of the sensor and directed towards the sensor zone.

11. A beverage dispenser system comprising:

a reservoir;

a beverage contained within the reservoir;

a dispensing spout configured to dispense the beverage;

a beverage container;

a sensor configured to detect when the beverage container is disposed in a sensor zone proximal the dispensing spout;

a pump operably coupled to the reservoir and the dispensing spout, the pump being configured to pump the beverage out of the dispensing spout upon the detection, by the sensor, of the beverage container being disposed in the sensor zone; and one or more ultraviolet lights configured to sanitize at least one of the dispensing spout and a portion of the sensor zone wherein the one or more ultraviolet lights are operative when the beverage container is disposed in the sensor zone.

12. The beverage dispenser system of claim 11, wherein the one or more ultraviolet lights continuously operate.

13. A method of dispensing a beverage, the method comprising:

providing a reservoir;

providing a beverage contained within the reservoir;

providing a dispensing spout that is configured to dispense the beverage;

providing a beverage container;

providing a sensor configured to detect when the beverage container is disposed in a sensor zone proximal the dispensing spout;

providing a pump operably coupled to the reservoir and the dispensing spout;

providing one or more ultraviolet lights that are operative when the beverage container is disposed in the sensor zone;

positioning the beverage container in the sensor zone;

detecting, by the sensor, the beverage container being disposed in the sensor zone;

sanitizing, with the one or more ultraviolet lights, at least one of the dispensing spout and a portion of the sensor zone; and pumping, by the pump, the beverage out of the dispensing spout.

* * * * *